US011840855B2

(12) United States Patent
McKnight

(10) Patent No.: US 11,840,855 B2
(45) Date of Patent: Dec. 12, 2023

(54) UMBRELLA POLE PROTECTING DEVICE

(71) Applicant: Jacob Todd McKnight, Cypress, TX (US)

(72) Inventor: Jacob Todd McKnight, Cypress, TX (US)

( * ) Notice: Subject to any disclaimer, the term of this patent is extended or adjusted under 35 U.S.C. 154(b) by 104 days.

(21) Appl. No.: 17/563,431

(22) Filed: Dec. 28, 2021

(65) Prior Publication Data

US 2023/0038595 A1 Feb. 9, 2023

Related U.S. Application Data

(60) Provisional application No. 63/231,207, filed on Aug. 9, 2021.

(51) Int. Cl.
*E04H 12/22* (2006.01)
*A45B 25/00* (2006.01)

(52) U.S. Cl.
CPC ..... *E04H 12/2292* (2013.01); *A45B 25/00* (2013.01); *A45B 2025/003* (2013.01)

(58) Field of Classification Search
CPC ..... E04H 12/2292; A45B 2025/003
See application file for complete search history.

(56) References Cited

U.S. PATENT DOCUMENTS 2,724,156 A * 11/1955 Shaw ..... E04H 12/2292 52/168
2,888,111 A * 5/1959 Evans ..... E04H 12/32 52/114
5,535,978 A * 7/1996 Rodriguez ..... E04H 12/2269 248/530
6,098,353 A * 8/2000 Stanfield ..... E01F 9/685 52/848
6,742,314 B2 * 6/2004 Young ..... E04C 3/30 52/835
7,437,857 B1 * 10/2008 Maguire ..... E02D 5/80 52/297
7,614,600 B1 11/2009 Smith
8,939,051 B1 1/2015 Lofley
9,155,387 B2 * 10/2015 Kaluzavich ..... E04H 12/2292
9,200,655 B2 12/2015 Pan
9,982,454 B2 * 5/2018 Knudsen ..... E04C 3/30
10,544,601 B2 1/2020 Hoek-Patterson
2019/0017285 A1 * 1/2019 Kain ..... E04H 17/08
(Continued)

OTHER PUBLICATIONS

Form Fit PVC Foundation Sleeve, Retrieved from Internet, Retrieved on Oct. 25, 2020 <URL: https://www.united-states-flag.com/form-fit-pvc-foundation-sleeve-3.html>.
(Continued)

*Primary Examiner* — Noah Chandler Hawk

(57) ABSTRACT

An umbrella pole protecting device is a protective sleeve for the lower pole section of a pool-side umbrella. In other words, the device is a protective sleeve that covers the lower pole section of an umbrella to prevent potential contact of water. Further, the device includes a gasket for providing a water-proof seal between the sleeve and the pole section of the umbrella. Additionally, a water-resistant coating on the protective sleeve prevents the sleeve from being subjected to water damage. Thus, the present invention is a simple yet effective solution for preventing damage of lower pole section of a pool umbrella.

15 Claims, 10 Drawing Sheets

(56) References Cited

U.S. PATENT DOCUMENTS

2020/0332549 A1* 10/2020 Flores ..... E04H 12/2292
2021/0246683 A1* 8/2021 Smith ..... E04H 17/22

OTHER PUBLICATIONS

Strong Camel Replacement Patio Umbrella Lower Pole, Retrieved from Internet, Retrieved on Oct. 25, 2020 <URL: https://www.amazon.com/Strong-Camel-Replacement-Patio-Umbrella/dp/B087JQKJJZ>.

8" Precision Machined Stainless Umbrella Sleeve with Cap, Retrieved from Internet, Retrieved on Oct. 25, 2020 <URL: https://www.coolpoolproducts.com/products.php?product=8%22-Precision-Machined-Stainless-Umbrella-Sleeve-w%7B47%7D-Cap>.

* cited by examiner

UMBRELLA POLE PROTECTING DEVICE

The current application claims a priority to the U.S. provisional patent application Ser. No. 63/231,207 filed on Aug. 9, 2021.

FIELD OF THE INVENTION

The present invention relates to protective sleeves. More specifically, the present invention is a protective sleeve for the lower pole section of umbrellas or of the likes.

BACKGROUND OF THE INVENTION

Relaxing at a pool can be a great activity on a hot sunny day. When it comes to relaxing at a pool, a pool umbrella is recommended as a method of staying away under the sun. One unnoticed problem that gradually occur over time is potential water damage of equipment. Water damage of any sort can be unexpected and gradually occurring before our eyes. For example, the lower pole section of a pool umbrella will most likely come to contact with water that will progressively damage the umbrella's lower pole section. Depending on the material of the pole and how the pole of the umbrella is designed, there are potential chances for water damage onto the pole over an extended period of time.

An objective of the present invention is to provide a protective sleeve for the lower pole section of a pool-side umbrella. In other words, the present invention is a protective sleeve that covers the lower pole section of an umbrella to prevent potential contact of water. Further, the present invention comprises a gasket that provides a water-proof seal between the sleeve and the pole section of the umbrella. Additionally, a water-resistant coating on the protective sleeve prevents the sleeve from being subjected to water damage. Thus, the present invention is a simple yet effective solution for preventing damage of lower pole section of a pool umbrella.

DETAIL DESCRIPTIONS OF THE INVENTION

Figure 1:
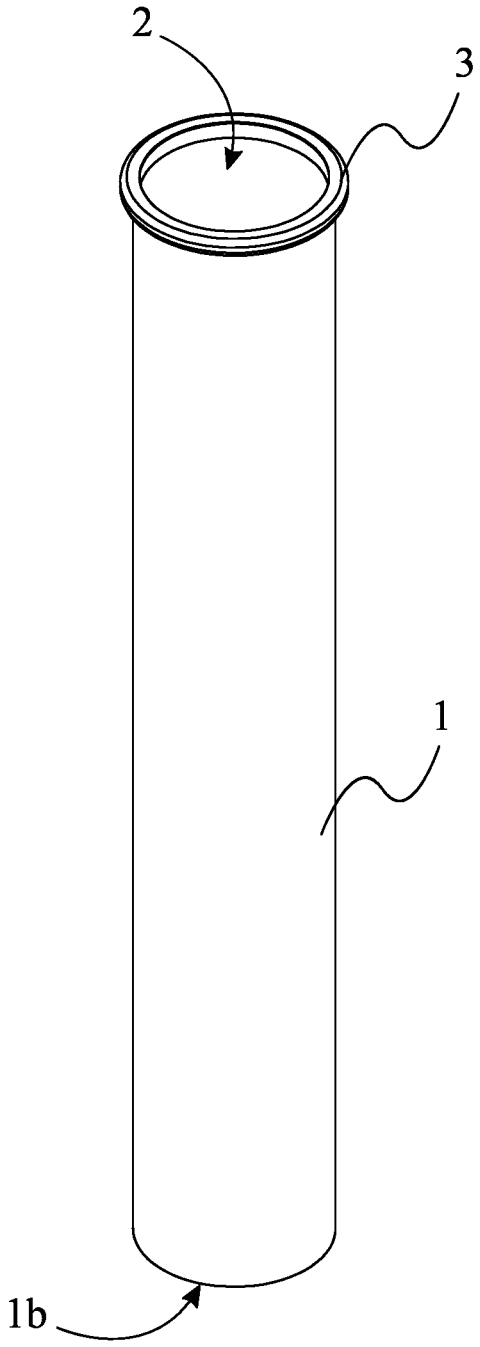
FIG. 1 is top-front-left perspective view of the present invention.
Figure 2:
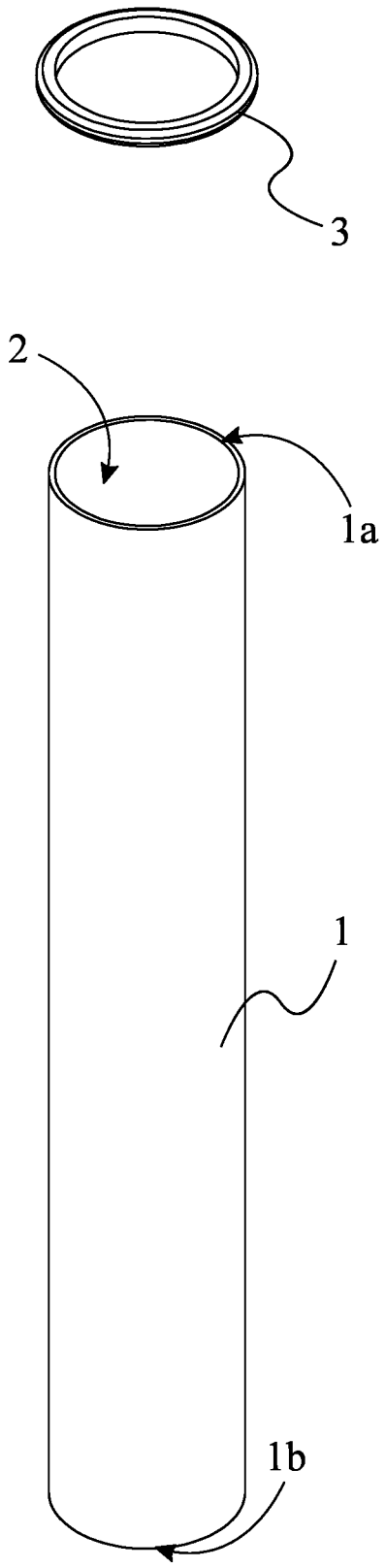
FIG. 2 is an exploded view of FIG. 1.
Figure 3:
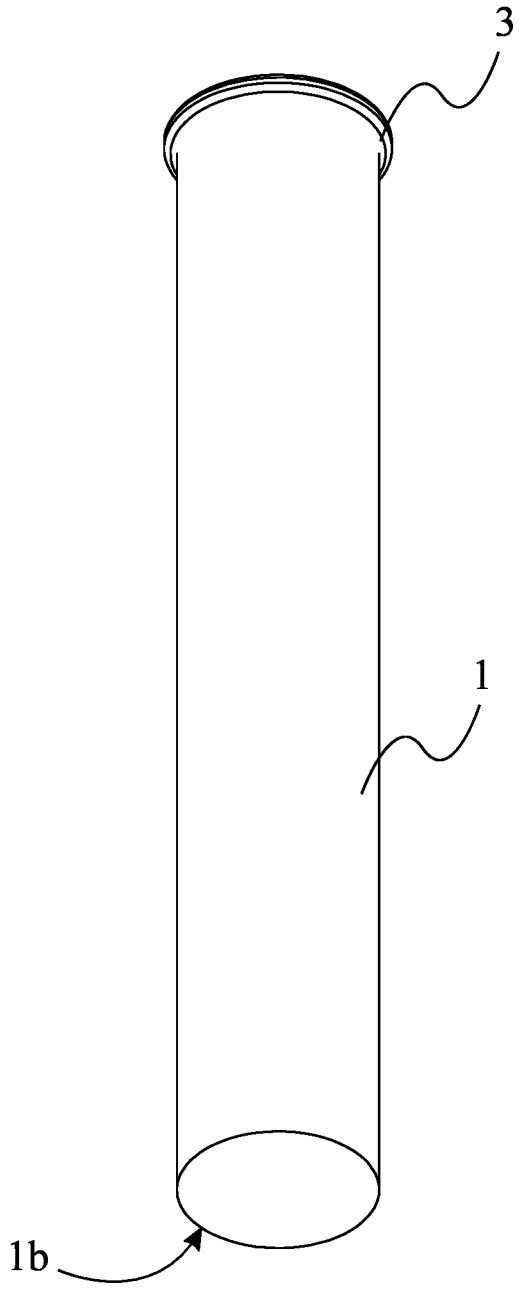
FIG. 3 is a bottom-rear-right perspective view of the present invention.
Figure 4:
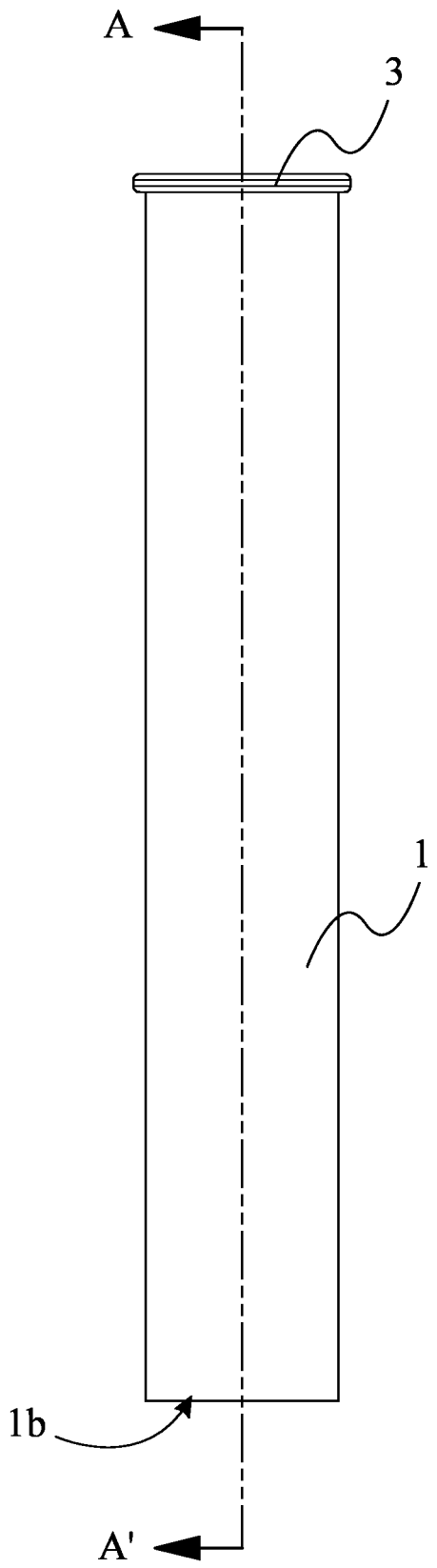
FIG. 4 is a front elevational view of the present invention.
Figure 5:
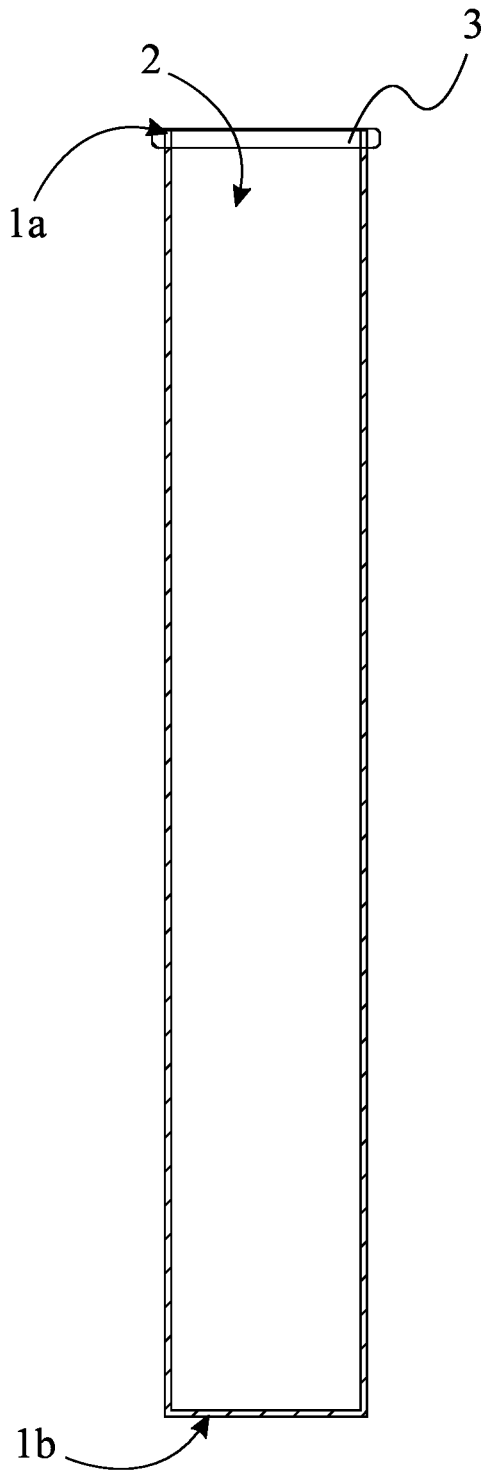
FIG. 5 is a sectional view of the present invention taken along A-A' of FIG. 3.
Figure 6:
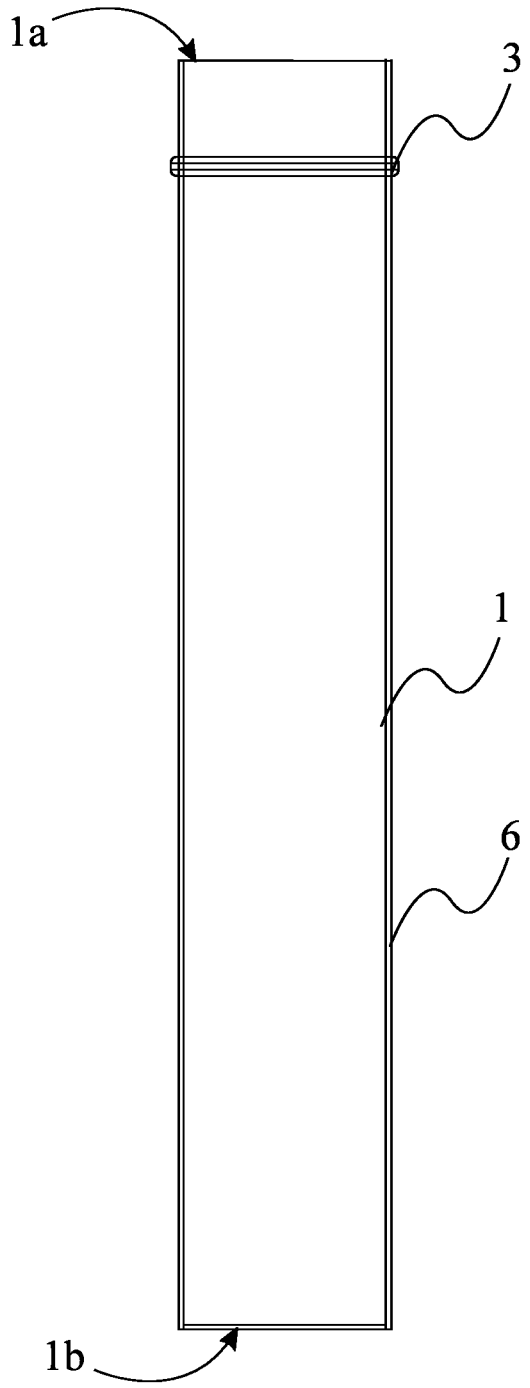
FIG. 6 is a front elevational view of the present invention, wherein a protective coating covers the sleeve, and the gasket is positioned below the top end of the sleeve.

All illustrations of the drawings are for the purpose of describing selected versions of the present invention and are not intended to limit the scope of the present invention.

In reference to FIG. 1 through FIG. 10, the present invention is an umbrella pole protector. An objective of the present invention is to provide a protective sleeve for the lower pole section of a poolside umbrella. In other words, the present invention is a protective sleeve that covers the lower pole section of an umbrella to prevent potential contact of water. Further, a gasket provides a water-proof seal between the sleeve and the pole section of the umbrella. Additionally, a water-resistant coating on the protective sleeve prevents the sleeve from being subjected to water damage. Thus, the present invention is a simple yet effective solution for damage of lower pole section of a pool umbrella.

The following description is in reference to FIG. 1 through FIG. 10. According to a preferred embodiment, the present invention comprises a sleeve 1, a cavity 2, and a gasket 3. Preferably, the sleeve 1 comprises a first end 1*a* and a second end 1*b*, wherein the first end 1*a* is positioned opposite to the second end 1*b* across the sleeve 1, and the cavity 2 traverses into the sleeve 1 from the first end 1*a* towards the second end 1*b*. As seen in FIG. 1 through FIG. 10, the first end 1*a* constitutes a top end of the sleeve 1, and the second end 1*b* constitutes a bottom end of the sleeve 1. Preferably, the sleeve 1 is a hollow cylindrical tube with an orifice on one end. The hollowness of the cylindrical body allows for the insertion of an umbrella. Further, the sleeve 1 is made of a water-resistant and water-proof material. However, the sleeve 1 may comprise any other material, components and arrangement of components as long as the intents of the present invention are not altered. Furthermore, the cylindrical body comprises of an open end and a closed end. In other words, the cavity 2 is exposed through the first end 1*a* of the sleeve 1, and the second end 1*b* of the sleeve 1 is enclosed. This is so that the lower end of the umbrella pole may rest on the enclosed end or the second end 1*b* of the sleeve 1.

In order to provide a watertight seal between an umbrella pole and the sleeve 1 regardless of the slight variations in dimensions between the umbrella pole and the sleeve 1, the gasket 3 is provided. According to the preferred embodiment, the gasket 3 is perimetrically mounted around the sleeve 1. Preferably, the gasket 3 is made of a waterproof and a flexible material. Further, in order to allow easy insertion of an umbrella pole within the sleeve 1 and to prevent any hinderance from the gasket 3 during insertion of the pole, the gasket 3 is made slidable across a length 1*c* of the sleeve 1. Thus, the gasket 3 is operably integrated between the cavity 2 and the sleeve 1, such that operating the gasket 3 provides a seal between the cavity 2 and a pole 4 of an umbrella 5 placed within the sleeve 3.

In order to further enhance protection from water, the present invention comprises a protective coating 6, wherein the protective coating 6 encompasses an external surface of the sleeve 1. To provide the necessary protection, the protective coating 6 is water resistant. Preferably the protective coating 6 is a water resistant and rust proof paint that may be coated over the sleeve 1. However, the protective coating 6 may comprise any other material that is known to one of ordinary skill in the art, as long as the intents of the present invention are not altered.

Figure 7:
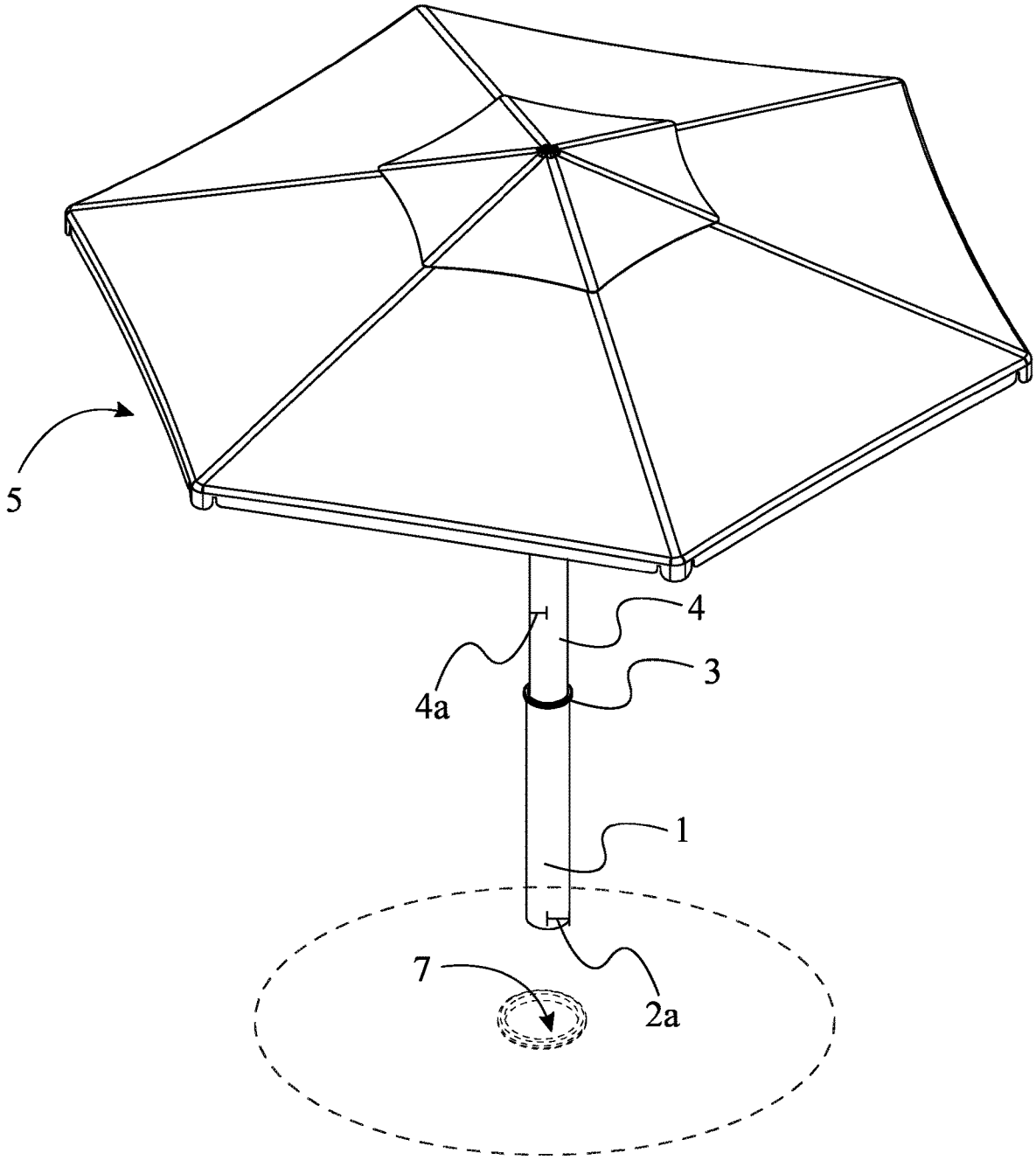
FIG. 7 is a top-front-left perspective view, wherein a lower pole section of a pool umbrella is being positioned within the present invention.
Figure 8:
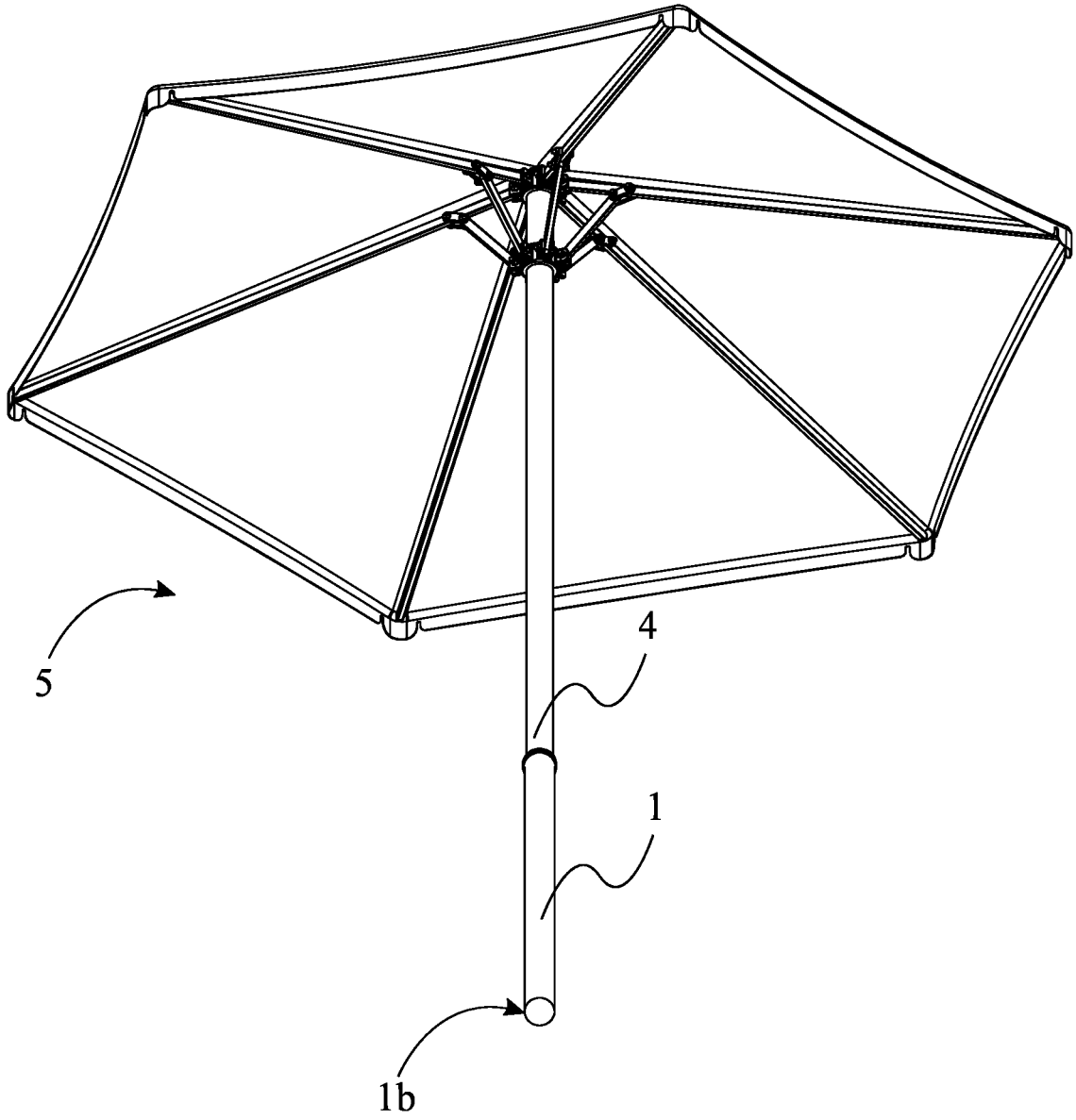
FIG. 8 is a bottom rear right perspective view, wherein the pole of a pool umbrella is inserted into the sleeve.

As seen in FIG. 7, the cavity 2 comprises a first radius 2*a*, and the pole 4 of the umbrella 5 comprises a second radius 4*a*. In order to enable a smooth and easy insertion and retrieval of the pole 4 of the umbrella 5 to and from the sleeve 1 respectively, the first radius 2*a* is slightly greater than the second radius 4*a*.

Figure 9:
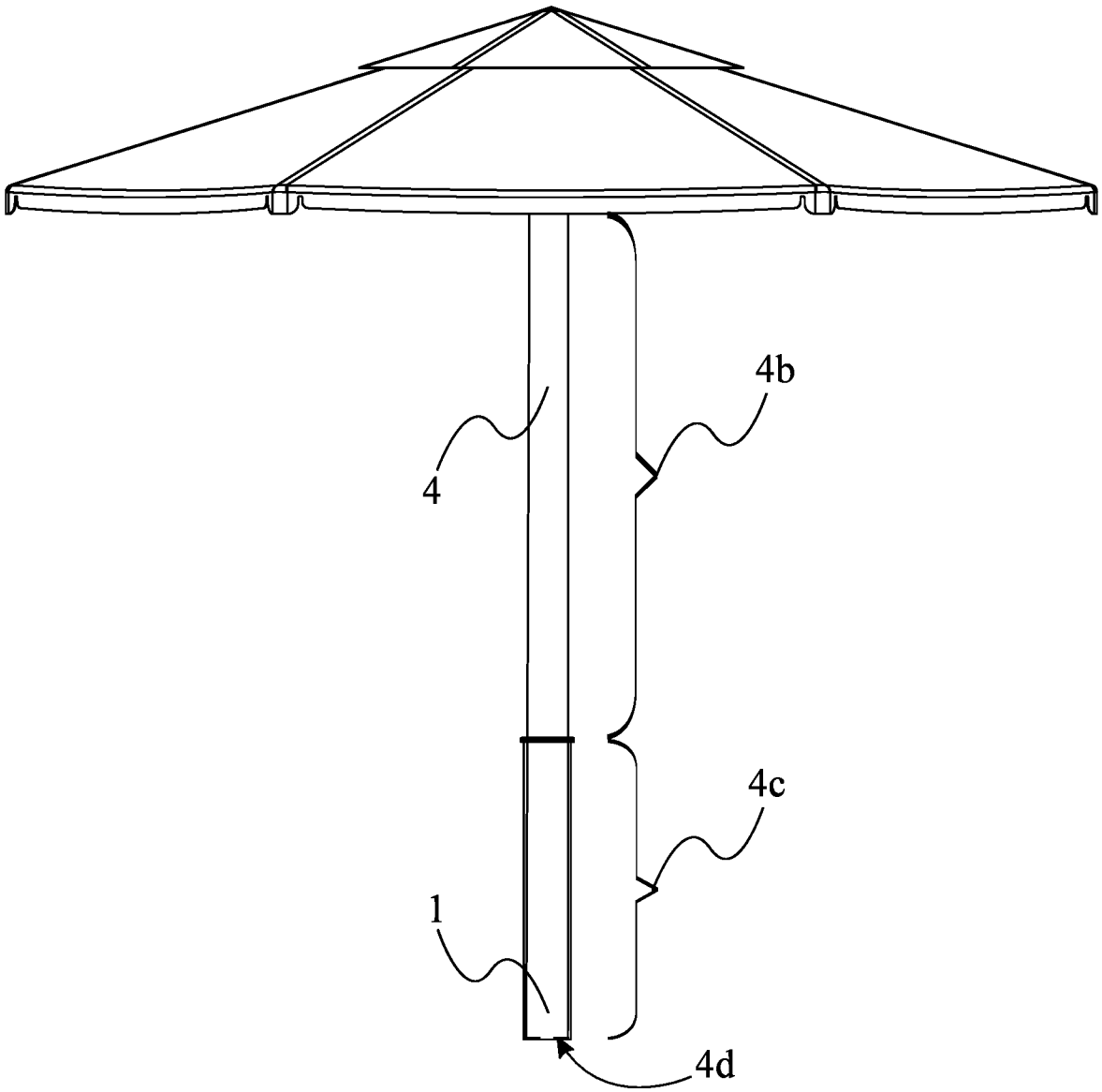
FIG. 9 is a side elevational view of the present invention, wherein the pole of a pool umbrella is inserted into the sleeve.
Figure 10:
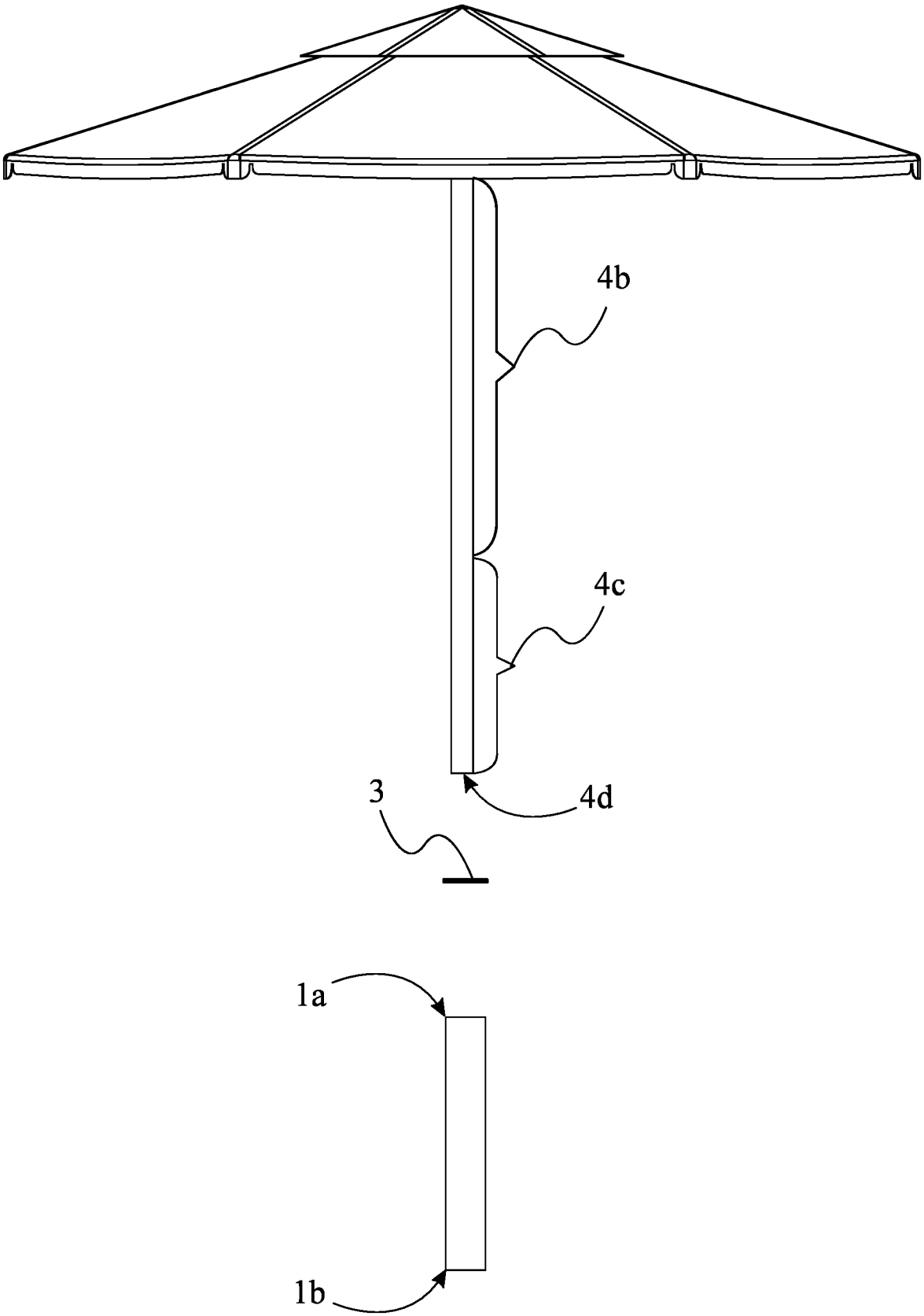
FIG. 10 is an exploded view of FIG. 9.

In reference to FIG. 9 and FIG. 10, the pole 4 of the umbrella 5 comprises a first section 4*b* and a second section 4*c*, wherein the first section 4*b* of the pole 4 is positioned opposite the second end 1*b* of the sleeve 1. Accordingly, wherein the pole 4 of the umbrella 5 is placed within the sleeve 1, the sleeve 1 encapsulates the second section 4*c* of the pole 4, and a terminal end 4*d* of the second section 4*c* touches the second end 1*b* of the sleeve 1. Further, a portion of the second section 4*c* of the pole 4 and the sleeve 1 is positioned within an umbrella-pole hole 7. In other words, when the present invention is in use, the sleeve 1 is positioned within an umbrella-pole hole 7 in the ground near a swimming pool and a portion of the second section 4*c* will be inserted within the sleeve 1. The rest of the sleeve 1, as well as the rest of the second section 4*c* will be positioned outside the pole hole and will be accessible to users. Thus, the second section 4*c* of the pole will be protected from all kinds of water damage.

In an alternate embodiment, the present invention may comprise a locking mechanism, wherein the locking mechanism is integrated between the sleeve 1 and the pole 4 of the umbrella 5. This is so that, the pole is 4 securely fastened within the sleeve and does not move or rotate within the sleeve due to wind or any other unpredicted weather conditions.

Although the invention has been explained in relation to its preferred embodiment, it is to be understood that many other possible modifications and variations can be made without departing from the spirit and scope of the invention as hereinafter claimed.

What is claimed is:

1. A water-resistant protective device, the device comprising:

a sleeve;

a cavity;

a gasket;

the sleeve comprising a first end and a second end, wherein the first end is positioned opposite to the second end across the sleeve;

the cavity traversing into the sleeve from the first end towards the second end;

the gasket being perimetrically mounted around the sleeve;

the gasket being slidable across a length of the sleeve;

a protective coating;

the protective coating encompassing an external surface of the sleeve; and wherein the protective coating is water resistant.

2. The protective device of claim 1, wherein the sleeve is cylindrical.

3. The protective device of claim 1, wherein the cavity is exposed through the first end of the sleeve, and the second end of the sleeve is enclosed.

4. The protective device of claim 1, wherein the gasket is waterproof.

5. The protective device of claim 1, wherein the gasket is flexible.

6. The protective device of claim 1, comprising:

the cavity comprising a first radius;

the pole of the umbrella comprising a second radius; and the first radius being slightly greater than the second radius.

7. The protective device of claim 1, comprising:

the pole of the umbrella comprising a first section and a second section;

wherein the pole of the umbrella being placed within the sleeve:

the sleeve encapsulating the second section of the pole; and a terminal end of the second section touching the second end of the sleeve.

8. The protective device of claim 7, wherein a portion of the second section of the pole and the sleeve are positioned within an umbrella-pole hole.

9. The protective device of claim 7, wherein the first section of the pole is positioned opposite the second end of the sleeve.

10. A water-resistant protective device for pool side umbrellas, the device comprising:

a sleeve;

a cavity;

a gasket;

the sleeve comprising a first end and a second end, wherein the first end is positioned opposite to the second end across the sleeve;

the cavity traversing into the sleeve from the first end towards the second end, wherein the cavity being exposed through the first end of the sleeve, wherein and the second end of the sleeve being enclosed;

the gasket being perimetrically mounted around the sleeve;

the gasket being slidable across a length of the sleeve;

a protective coating;

the protective coating encompassing an external surface of the sleeve, wherein the protective coating being water resistant; and wherein the gasket is flexible and waterproof.

11. The protective device of claim 10, wherein the sleeve is cylindrical.

12. The protective device of claim 10, comprising:

the cavity comprising a first radius;

the pole of the umbrella comprising a second radius; and the first radius being slightly greater than the second radius.

13. The protective device of claim 10, comprising:

the pole of the umbrella comprising a first section and a second section;

wherein the pole of the umbrella being placed within the sleeve:

the sleeve encapsulating the second section of the pole; and a terminal end of the second section touching the second end of the sleeve.

14. The protective device of claim 13, wherein a portion of the second section of the pole and the sleeve are positioned within an umbrella-pole hole.

15. The protective device of claim 13, wherein the first section of the pole is positioned opposite the second end of the sleeve.

* * * * *